US005398948A

United States Patent [19]

Mathis

[11] Patent Number: 5,398,948

[45] Date of Patent: Mar. 21, 1995

[54] DAMPING MECHANISM FOR ROLLER SKATE

[76] Inventor: Ronald J. Mathis, 22 Alice Ct., E. Rockaway, N.Y. 11518

[21] Appl. No.: 97,074

[22] Filed: Jul. 23, 1993

[51] Int. Cl.[6] ..... A63C 17/00

[52] U.S. Cl. ..... 280/11.19; 280/11.27; 280/759; 224/148

[58] Field of Search ..... 280/11.19, 11.2, 11.27, 280/11.28, 87.042, 758, 759; 224/148

[56] References Cited

U.S. PATENT DOCUMENTS

| | | | |
|---|---|---|---|
| 4,138,177 | 2/1979 | Kimmell et al. | 280/11.28 |
| 4,754,902 | 7/1988 | Opfergelt | 224/148 |
| 4,974,762 | 12/1990 | Boretsky et al. | 224/148 |
| 5,029,882 | 7/1991 | Marandel | 280/11.28 |
| 5,105,958 | 4/1992 | Patton | 224/148 |
| 5,146,949 | 9/1992 | Luca | 224/148 |
| 5,150,785 | 9/1992 | Kelley et al. | 224/148 |
| 5,183,277 | 2/1993 | Tang | 280/11.28 |

*Primary Examiner*—Richard M. Camby
*Attorney, Agent, or Firm*—Harris Beach & Wilcox

[57] ABSTRACT

A skate having a damping mechanism secured thereto to reduce the harmful vibrational stress from being transmitted through the skate to the wearer's leg.

5 Claims, 2 Drawing Sheets

DAMPING MECHANISM FOR ROLLER SKATE

BACKGROUND OF THE INVENTION

This invention relates to a skate having inline wheels and, in particular, to an inline skate having a damping system for reducing the amount of vibration imparted to the wearer when traveling over rough surfaces.

With the advent of inline skates, that is, skates equipped with wheels that are placed in alignment one behind the other, the sport of outdoor roller skating has gained renewed interest. People are now skating on boardwalks, cement walks, roadways and the like. The speeds that can be attained with the latest inline equipment are relatively high and as a consequence, harmful vibrations are transmitted through the skate to the leg of the wearer. Constant exposure to vibrations can not only be tiring, but also dangerous in that it may produce a fall particularly when travelling at high speed.

OBJECTS AND SUMMARY OF THE INVENTION

It is therefore an object of the present invention to improve inline roller skates.

It is another object of the present invention to improve the safety of inline roller skates.

It is a further object of the present invention to reduce the effects of vibrations on the leg of a skater.

Another object of the present invention is to provide a damping system for an inline roller skate.

Yet another object of the present invention is to provide a simple vibration damper that can be easily attached to an inline skate.

These and other and further objects of the present invention are attained by a skate that includes a boot having a shell and a sole plate mounted on the bottom of the boot, a wheel frame secured to the sole plate for rotatably supporting a plurality of wheels and a vibration damping mechanism for reducing the effects of vibrations.

DETAILED DESCRIPTION OF A PREFERRED EMBODIMENT

Figure 1:
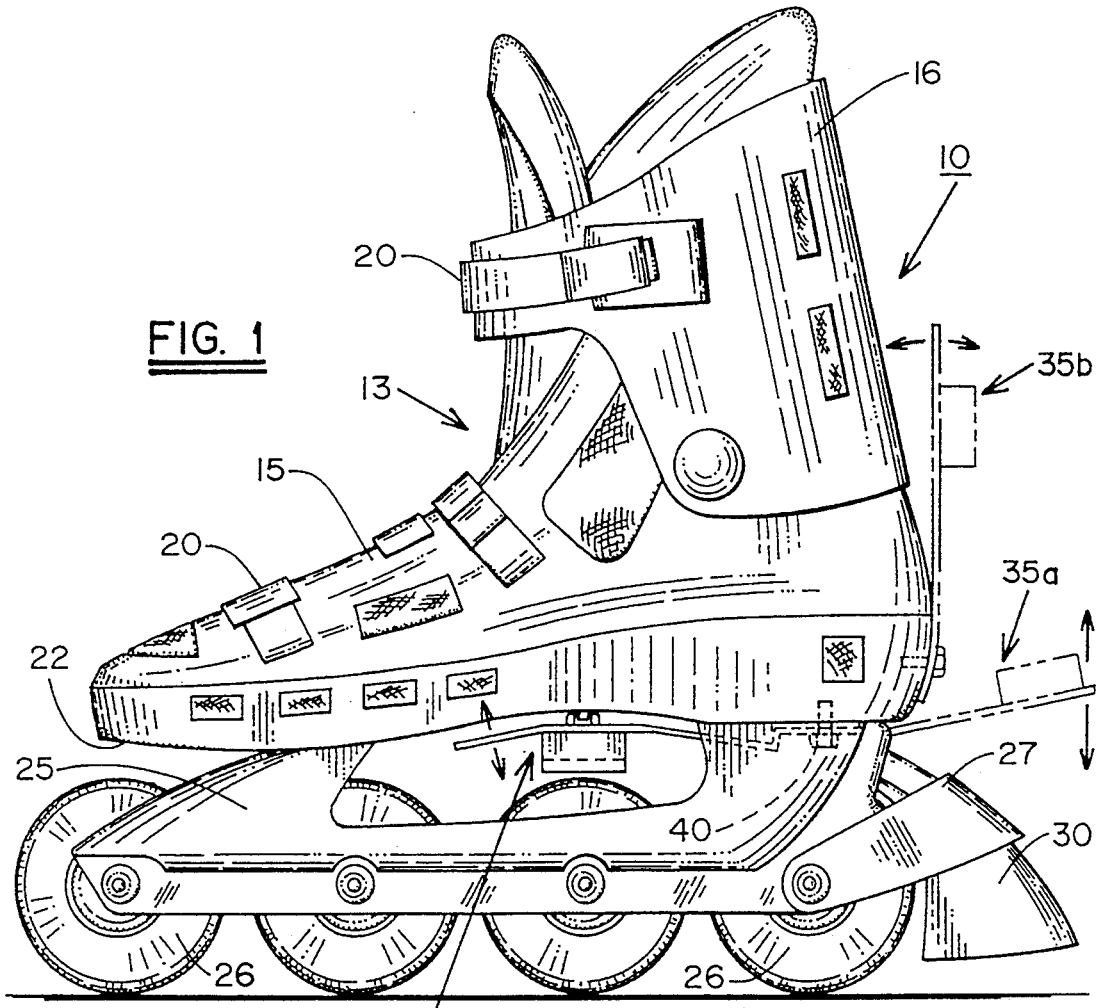
FIG. 1 is a side elevation of an inline roller skate incorporating the teachings of the present invention.

Referring initially to FIG. 1 there is shown an inline roller skate generally referenced 10 incorporating a spring damping system for reducing the effects of vibrations that might be otherwise transmitted to the wearer's leg. The skate includes a boot 13 that includes a hard high strength shell made of plastic or leather 15 upon which a collar 16 is mounted for articulation about a pair of rotors, one of which is shown at 17. The boot contains a liner 19 and is held snugly to the wearer's leg by means of a number of adjustable clamping members 20—20. The bottom of the boot includes a sole plate 22 which can be a separate piece or molded as part of the boot shell. A wheel frame 25 is secured to the sole plate and is adapted to rotatably support a series of inline, spaced apart, wheels 26—26. A brake support 27 is attached to the frame which holds a brake shoe 30 behind the rear wheel. A damping mechanism 35 is mounted upon the sole plate over the wheel assembly.

As noted above, inline skates are capable of attaining relatively high speeds and are oftentimes used on rough surfaces. As a consequence, oscillations of different frequencies and amplitudes can be transmitted through the skate to the wearer. These oscillations can, under certain conditions, produce fatigue and cause the skater to lose control of the skate causing a fall and possible injury to the skater.

Figure 2:
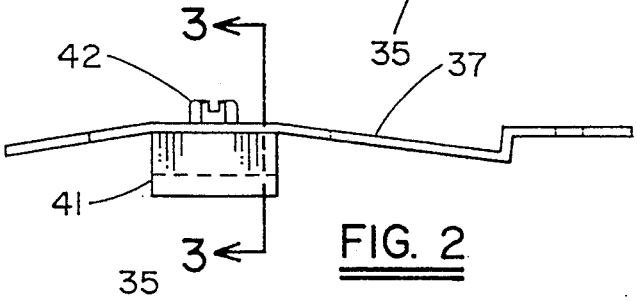
FIG. 2 is an enlarged side elevation of the damping device used in association with the skate shown in FIG. 1.
Figure 3:
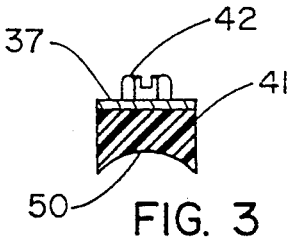
FIG. 3 is a section taken along line 3—3 in FIG. 2.
Figure 4:
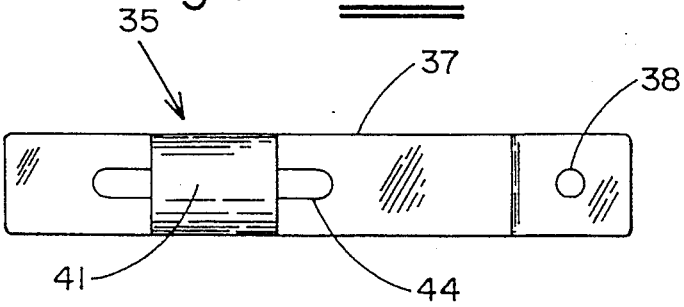
FIG. 4 is a bottom view of the damping device shown in FIG. 2.

With further reference to FIGS. 2–4, the damping mechanism 35 is shown in greater detail. The mechanism includes a flat spring 37 having a hole 38 at its proximal end capable of receiving a threaded fastener 40 (FIG. 1) used to attach the wheel frame to the boot sole plate. A weight 41 is affixed to the distal end of the spring by means of a screw 42. The shank of the screw passes through a slotted hole 44 formed in the spring. As can be seen, the longitudinal position of the weight upon the spring can be altered, thus permitting the damping mechanism to be tuned to provide a desired response. By the same token, the weight can be removed and replaced with a weight of greater or lesser mass. The weight, as shown in FIG. 1, is cantilevered on the spring and has a groove 50 formed in the bottom surface to prevent the weight from contacting the adjacent wheel when the spring is forced into vibration. The damping provided by this arrangement is sometimes referred to as solid damping and is proportional to the maximum value of stress by the vibrations.

Although the damping mechanism 35 is shown secured to the underside of the boot, the position of the mechanism may be varied as indicated by the various damping mechanism shown in phantom outline in FIG. 1. For example, the mechanism **35*a* may be secured at the proximal end of the spring to the boot sole or the wheel frame so that the distal end of the spring member protrudes beyond the back or spine of the boot. In this arrangement, the weight may be placed on the top surface of the spring rather than the bottom surface. Because the mechanism extends behind the boot, it will not effect the wearer's ability to perform the skating exercise. Similarly, the spring of mechanism 35*b*** may be connected to the spine of the boot in a vertical or near vertical position with the weight facing away from the boot. In this embodiment, it may be preferable to employ a softer spring to produce the desired damping action.

Figure 5:
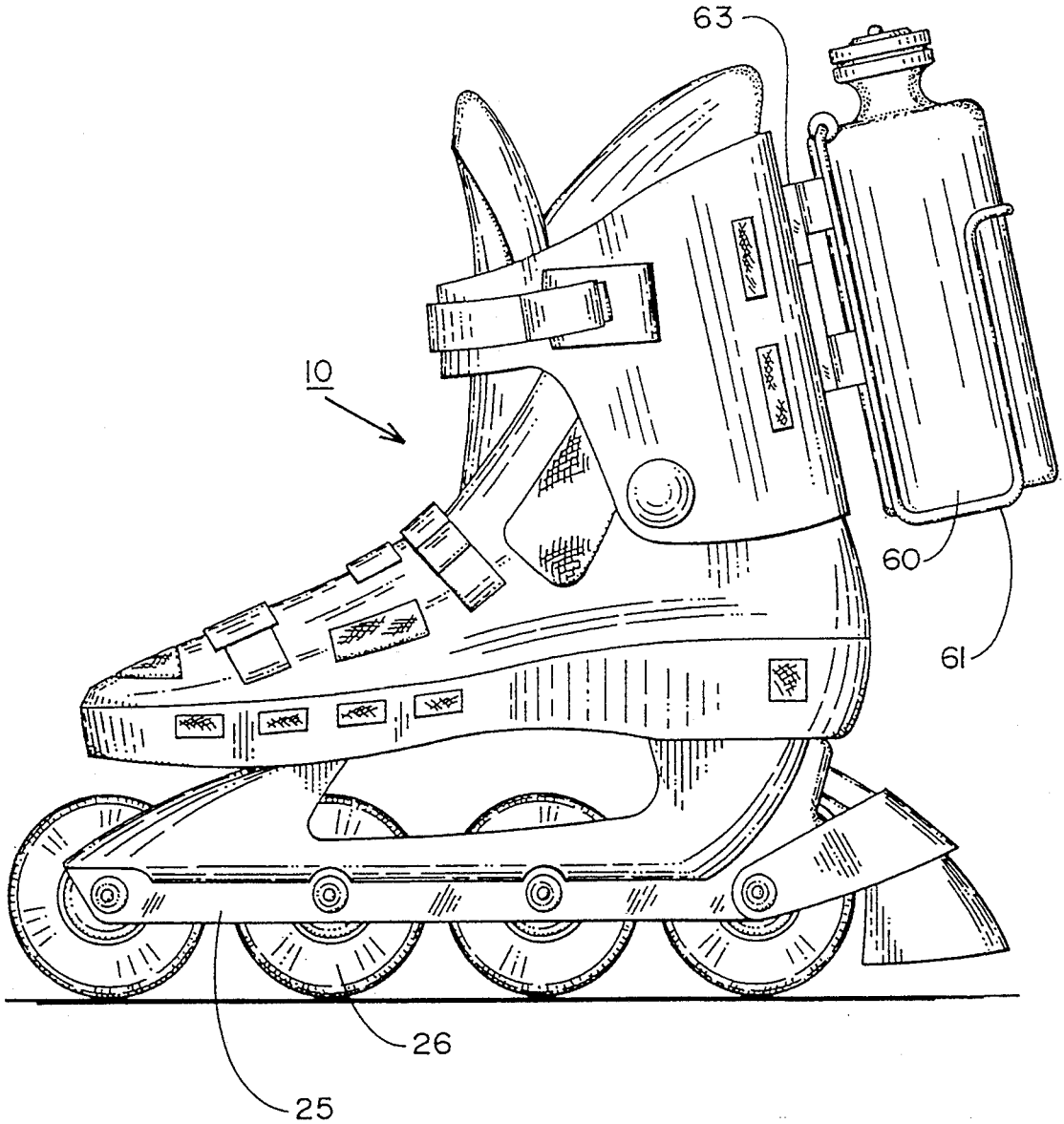
FIG. 5 is a side elevation showing an inline roller skate incorporating a further embodiment of the present invention.

FIG. 5 shows another embodiment of the invention in which a container 60 is hung on the back of the boot by means of a flexible bracket 61 formed of spring steel or plastic. The bracket may be suspended from the spine of the boot by any suitable means such as a support plate 63. The container is preferably filled with a desired amount of liquid to adjust the level of damping. Materials such as sand or other particulate materials may be similarly employed in place of liquid. Here again, the level of damping is proportional to the maximum value of stress developed by the induced vibration.

While this invention has been explained with reference to the structure disclosed herein, it is not confined to the details set forth and this invention is intended to cover any modifications and changes as may come within the scope of the following claims:

What is claimed is:

1. A roller skate that includes a boot that further includes a shell for embracing the foot and lower leg of a wearer and a sole plate secured to the bottom of the shell, a wheel frame secured to the sole plate for rotatably supporting a plurality of wheel whereby the skate can move in rolling contact over a contact surface, a damping system that includes an elongated flexible member that is secured at one end to the boot and a weight means of predetermined mass secured to the opposite end of the flexible member so that the weight means is caused to vibrate at the end of said member as the wheels move over a rough surface to reduce the effects of contact surface induced oscillations.

2. The roller skate of claim 1 wherein the weight means is removably secured to the free end of said flexible member whereby the mass of the weight means may be changed to increase or decrease the effect of damping.

3. The roller skate of claim 1 that further includes adjustable means for securing the weight to the free end of said flexible member so that the weight can be selectively positioned along the length of the flexible member to change the damping effect of the system.

4. The roller skate of claim 1 wherein said one end of the flexible member is secured the sole plate of the boot.

5. The roller skate of claim 1 wherein said one end of the flexible member is secured to the shell of the boot.

* * * * *